US008901061B2

(12) United States Patent
D'Ambrogio et al.

(10) Patent No.: US 8,901,061 B2
(45) Date of Patent: Dec. 2, 2014

(54) CHOLINE SALT CLEANING COMPOSITIONS

(75) Inventors: Robert D'Ambrogio, Princeton, NJ (US); Deborah A. Peru, Lebanon, NJ (US); Karen Wisniewski, Bound Brook, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/118,034

(22) PCT Filed: Oct. 21, 2011

(86) PCT No.: PCT/US2011/057269

§ 371 (c)(1),
(2), (4) Date: Nov. 15, 2013

(87) PCT Pub. No.: WO2012/177276

PCT Pub. Date: Dec. 27, 2012

(65) Prior Publication Data

US 2014/0090671 A1 Apr. 3, 2014

Related U.S. Application Data

(60) Provisional application No. 61/499,722, filed on Jun. 22, 2011.

(51) Int. Cl.
*C11D 3/30* (2006.01)
*C11D 3/00* (2006.01)
*C11D 17/00* (2006.01)

(52) U.S. Cl.
CPC ..... *C11D 3/30* (2013.01); *C11D 17/0021* (2013.01); *C11D 3/0057* (2013.01)
USPC ..... 510/365; 510/417; 510/504

(58) Field of Classification Search
CPC ..... C11D 17/0021; C11D 3/30
USPC ..... 510/417, 365, 504
See application file for complete search history.

(56) References Cited

U.S. PATENT DOCUMENTS

| | | | | |
|---|---|---|---|---|
| 3,320,174 | A | 5/1967 | Rubhifeld | |
| 5,415,813 | A * | 5/1995 | Misselyn et al. | 510/365 |
| 5,441,541 | A | 8/1995 | Mehreteab et al. | |
| 5,552,089 | A * | 9/1996 | Misselyn et al. | 510/417 |
| 5,716,925 | A * | 2/1998 | Mondin et al. | 510/365 |
| 5,912,222 | A * | 6/1999 | Thomas et al. | 510/417 |
| 6,274,645 | B1 * | 8/2001 | Gundlach et al. | 523/160 |
| 6,627,589 | B1 | 9/2003 | Arvanitidou | |
| 7,252,791 | B2 | 8/2007 | Wasserscheid et al. | |
| 7,544,807 | B2 | 6/2009 | Wasserscheid et al. | |
| 7,544,838 | B2 | 6/2009 | Forman et al. | |
| 7,655,803 | B2 | 2/2010 | Wasserscheid et al. | |
| 7,737,102 | B2 | 6/2010 | Hecht et al. | |
| 7,744,838 | B2 | 6/2010 | Davis, Jr. | |
| 8,110,537 | B2 * | 2/2012 | Gohl et al. | 510/328 |
| 2002/0010113 | A1 * | 1/2002 | Kilpatrick-Liverman et al. | 510/130 |
| 2003/0171239 | A1 * | 9/2003 | Patel et al. | 510/406 |
| 2004/0077519 | A1 | 4/2004 | Price et al. | |
| 2004/0097755 | A1 * | 5/2004 | Abbott et al. | 562/553 |
| 2004/0138084 | A1 * | 7/2004 | Gohl et al. | 510/417 |
| 2004/0147421 | A1 * | 7/2004 | Charm et al. | 510/176 |
| 2004/0154231 | A1 * | 8/2004 | Lee et al. | 51/309 |
| 2005/0085407 | A1 * | 4/2005 | Oldenhove et al. | 510/504 |
| 2005/0131118 | A1 | 6/2005 | Moulton et al. | |
| 2006/0078526 | A1 * | 4/2006 | Boyd et al. | 424/70.13 |
| 2006/0090271 | A1 | 5/2006 | Price et al. | |
| 2006/0094615 | A1 | 5/2006 | Hecht et al. | |
| 2006/0094616 | A1 | 5/2006 | Hecht et al. | |
| 2006/0094617 | A1 | 5/2006 | Price et al. | |
| 2006/0094620 | A1 | 5/2006 | Jordan et al. | |
| 2006/0094621 | A1 | 5/2006 | Jordan et al. | |
| 2006/0183654 | A1 | 8/2006 | Small | |
| 2006/0189499 | A1 | 8/2006 | Hecht et al. | |
| 2006/0240727 | A1 | 10/2006 | Price et al. | |
| 2006/0240728 | A1 | 10/2006 | Price et al. | |
| 2008/0017224 | A1 | 1/2008 | Price et al. | |
| 2008/0033178 | A1 | 2/2008 | Wasserscheid et al. | |
| 2008/0070966 | A1 | 3/2008 | Elder et al. | |
| 2009/0233829 | A1 | 9/2009 | Hecht et al. | |
| 2010/0016205 | A1 | 1/2010 | Schwab | |
| 2010/0209991 | A1 | 8/2010 | Hecht et al. | |
| 2012/0295820 | A1 * | 11/2012 | Falana et al. | 507/128 |

FOREIGN PATENT DOCUMENTS

| | | |
|---|---|---|
| JP | 11-326906 | 11/1999 |
| WO | WO 91/16410 | 10/1991 |
| WO | WO 03/028883 | 4/2003 |
| WO | WO 2006/131234 | 12/2006 |
| WO | WO 2010/078300 | 7/2010 |

OTHER PUBLICATIONS

Park et al., "Improved preparation and use of room-temperature ionic liquids in lipase-catalyzed enantio- and regioselective acylations," J. Org. Chem., 66(25)18395-8401, Dec. 14, 2001.
Mehta et al., "Ionic liquid microemulsions and their technological applications," Indian J. of Chemistry, May-Jun. 2010, 49A:662-684.
Summers et al., "Protein renaturation by the liquid organic salt ethylammonium nitrate," Protein Science, 2000, 9-2001-2008.
International Search Report and Written Opinion for PCT Application No. PCT/US2011/057269 mailed on Feb. 6, 2012.

* cited by examiner

*Primary Examiner* — Gregory Webb
(74) *Attorney, Agent, or Firm* — Michael F. Morgan

(57) ABSTRACT

A cleaning composition comprising a choline salt and a surfactant or solvent. Also, a method of cleaning using the cleaning composition.

25 Claims, No Drawings

CHOLINE SALT CLEANING COMPOSITIONS

CROSS REFERENCE TO RELATED APPLICATIONS

This application claims priority to U.S. Provisional Patent Application No. 61/499,722, filed on 22 Jun. 2011, which is incorporated herein by reference.

FIELD OF THE INVENTION

The present invention relates to choline salts in cleaning compositions.

BACKGROUND OF THE INVENTION

Tough food soil removal through quicker, more effortless means is a continuing goal in dishwashing. Most attention historically has been given to pure grease soils. Also, everyday cleaning needs are readily met by conventional cleaners and cleaning equipment. Removal of heavily encrusted and burnt on soils, however, remains a challenge. Common approaches include prolonged soaking and/or heavy scouring. Specialty solutions such as pre-treatment products can be generally effective but very abrasive or harsh (high pH) on hands and surfaces. Also, they are inconvenient to the consumer since multiple products are required for complete cleaning. An increasing problem comes from the greater use of microwave ovens that provide more intensive cooking.

It would be desirable to have a cleaner that is effective on tough soil removal.

BRIEF SUMMARY OF THE INVENTION

Provided is a cleaning composition comprising at least 7.5% by weight choline chloride and at least one of a surfactant and a solvent. Provided is a cleaning composition comprising choline bicarbonate, surfactant, and solvent. Provided is a cleaning composition comprising at least 0.5% by weight of at least one choline salt chosen from choline salicylate and choline dihydrogencitrate, and at least one of a surfactant and a solvent.

Also, a method of cleaning comprising applying the cleaning composition to a substrate, and optionally removing the cleaning composition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

The composition includes a choline salt to improve the cleaning efficiency of the composition.

In certain embodiments, the amount of choline chloride is at least 7.5%, at least 10%, at least 15%, at least 20%, at least 25, at least 30%, at least 35%, at least 40%, at least 50%, at least 55%, at least 60%, at least 65%, at least 70%, at least 75% by weight, at least 80%, at least 85%, or at least 90% by weight. In certain embodiments, the amount of choline bicarbonate is at least 1%, at least 5%, at least 7.5%, at least 10%, at least 15%, at least 20%, at least 25, at least 30%, at least 35%, at least 40%, at least 50%, at least 55%, at least 60%, at least 65%, at least 70%, at least 75% by weight, at least 80%, at least 85%, or at least 90% by weight. In certain embodiments, the amount of choline salicylate and/or choline dihydrogencitrate is at least 0.5%, at least 1%, at least 5%, at least 7.5%, at least 10%, at least 15%, at least 20%, at least 25, at least 30%, at least 35%, at least 40%, at least 50%, at least 55%, at least 60%, at least 65%, at least 70%, at least 75% by weight, at least 80%, at least 85%, or at least 90% by weight.

The composition optionally contains a hydrogen bond donor for the choline salt. Examples of the hydrogen bond donor include, but are not limited to, urea, aromatic carboxylic acids or their salts, salicylic acid, salicylate, benzoic acid, benzoate, dicarboxylic acids or their salts, oxalic acid, malonic acid, succinic acid, glutaric acid, adipic acid, tartaric acid, tricarboxylic acids or their salts, citric acid or its salts.

In certain embodiments, the amount of hydrogen bond donor is at least 1%, at least 5%, at least 10%, at least 15%, at least 20%, at least 25%, at least 30%, at least 35%, at least 40%, at least 50%, at least 55%, at least 60%, at least 65%, at least 70%, or at least 75% by weight.

The hydrogen bond donor can be present in a weight ratio with the choline salt in a ratio of hydrogen bond donor to choline salt of 1:1 to 4:1. In certain embodiments, the ratio is about 1:1. In other embodiments, the ratio is about 2:1 or about 3:1.

Choline chloride itself is not a liquid salt as its melting point is significantly above 100° C. (upper limit indicated by liquid salt definition). The combination of urea and choline chloride, however, forms what is termed a "deep eutectic solvent" that displays liquid salt-like properties in terms of unusually low melting point. The optimum molar ratio of urea to choline chloride, in terms of lowest melting point depression, is reported to be 2:1, respectively. Surprisingly, it has been tbund in our research that this deep eutectic liquid also provides effective solvation of tenacious food soils. Further, we have found that a 2:1 weight ratio of urea to choline chloride appears to be optimal in terms of food cleaning. Urea formulated with choline chloride in aqueous solutions ranging from 1:1 to 4:1 weight ratio, respectively, provided improved cleaning of food soils above the capability of the individual ingredients.

In certain embodiments, the composition contains at least one surfactant. In certain embodiments, the amount of surfactant is 0.1 to 45% by weight. In other embodiments, the amount of surfactant is at least 0.1%, at least 1%, at least 5%, at least 10%, at least 15%, at least 20%, at least 25%, at least 30%, at least 35%, or at least 40% by weight. The surfactant can be any surfactant or any combination of surfactants. Examples of surfactants include anionic, nonionic, cationic, amphoteric, or zwitterionic. In certain embodiments, the surfactant comprises a nonionic surfactant, an amphoteric surfactant, or both.

Anionic surfactants include, but are not limited to, those surface-active or detergent compounds that contain an organic hydrophobic group containing generally 8 to 26 carbon atoms or generally 10 to 18 carbon atoms in their molecular structure and at least one water-solubilizing group selected from sulfonate, sulfate, and carboxylate so as to form a water-soluble detergent. Usually, the hydrophobic group will comprise a $C_8$-$C_{22}$ alkyl, or acyl group. Such surfactants are employed in the form of water-soluble salts and the salt-forming cation usually is selected from sodium, potassium, ammonium, magnesium and mono-, di- or tri-$C_2$-$C_3$ alkanolammonium, with the sodium, magnesium and ammonium cations again being the usual ones chosen.

The anionic surfactants that are used in the composition of this invention are water soluble and include, but are not limited to, the sodium, potassium, ammonium, and ethanolammonium salts of linear $C_8$-$C_{16}$ alkyl benzene sulfonates, alkyl ether carboxylates, $C_{10}$-$C_{20}$ paraffin sulfonates, $C_8$-$C_{25}$ alpha olefin sulfonates, $C_8$-$C_{18}$ alkyl sulfates, alkyl ether sulfates and mixtures thereof.

The paraffin sulfonates (also known as secondary alkane sulfonates) may be monosulfonates or di-sulfonates and usually are mixtures thereof, obtained by sulfonating paraffins of 10 to 20 carbon atoms. Commonly used paraffin sulfonates are those of C12-18 carbon atoms chains, and more commonly they are of C14-17 chains. Such compounds may be made to specifications and desirably the content of paraffin sulfbnates outside the C14-17 range will be minor and will be minimized, as will be any contents of di- or poly-sulfonates. Examples of paraffin sulfonates include, but are not limited to HOSTAPUR™ SAS30, SAS 60, SAS 93 secondary alkane sulfonates from Clariant, and BIO-TERGE™ surfactants from Stepan, and CAS No. 68037-49-0.

Pareth sulfate surfactants can also be included in the composition. The pareth sulfate surfactant is a salt of an ethoxylated $C_{10}$-$C_{16}$ pareth sulfate surfactant having 1 to 30 moles of ethylene oxide. In some embodiments, the amount of ethylene oxide is 1 to 6 moles, and in other embodiments it is 2 to 3 moles, and in another embodiment it is 2 moles. In one embodiment, the pareth sulfate is a $C_{12}$-$C_{13}$ pareth sulfate with 2 moles of ethylene oxide. An example of a pareth sulfate surfactant is STEOL™ 23-2S/70 from Stepan, or (CAS No. 68585-34-2).

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. In one embodiment, the alkylbenzene sulfonate is a linear alkylbenzene sulfonate haying a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Materials that can be used are found in U.S. Pat. No. 3,320,174, especially those in which the alkyls are of 10 to 13 carbon atoms.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. In one embodiment, olefin sulfonates contain from 14 to 16 carbon atoms in the R alkyl group and are obtained by sulfonating an a-olefin.

Examples of satisfactory anionic sulfate surfactants are the alkyl sulfate salts and the and the alkyl ether polyethenoxy sulfate salts having the formula $R(OC_2H_4)_nOSO_3M$ wherein n is 1 to 12, or 1 to 5, and R is an alkyl group having about 8 to about 18 carbon atoms, or 12 to 15 and natural cuts, for example, $C_{12-14}$ or $C_{12-16}$ and M is a solubilizing cation selected from sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

The ethoxylated alkyl ether sulfate may be made by sulfating the condensation product of ethylene oxide and $C_{8-18}$ alkanol, and neutralizing the resultant product. The ethoxylated alkyl ether sulfates differ from one another in the number of carbon atoms in the alcohols and in the number of moles of ethylene oxide reacted with one mole of such alcohol. In one embodiment, alkyl ether sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

Other suitable anionic detergents are the $C_9$-$C_{15}$ alkyl ether polyethenoxylcarboxylates having the structural formula $R(OC_2H_4)_nOX$ COOH wherein n is a number from 4 to 12, preferably 6 to 11 and X is selected from the group consisting of $CH_2$, $C(O)R_1$ and

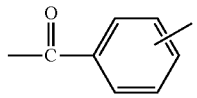

wherein $R_1$ is a $C_1$-$C_3$ alkylene group. Types of these compounds include, but are not limited to, $C_9$-$C_{11}$ alkyl ether polyethenoxy (7-9) $C(O)CH_2CH_2COOH$, $C_{13}$-$C_{15}$ alkyl ether polyethenoxy (7-9)

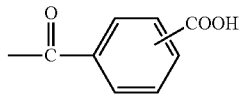

and $C_{10}$-$C_{12}$ alkyl ether polyethenoxy (5-7) $CH_2COOH$. These compounds may be prepared by condensing ethylene oxide with appropriate alkanol and reacting this reaction product with chloracetic acid to make the ether carboxylic acids as shown in U.S. Pat. No. 3,741,911 or with succinic anhydride or phtalic anhydride.

The amine oxide is depicted by the formula:

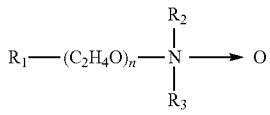

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms; $R_2$ and $R_3$ are each methyl, ethyl, propyl, isopropyl, 2-hydroxyethyl, 2-hydroxypropyl, or 3-hydroxypropyl; and n is from 0 to about 10. In one embodiment, the amine oxides are of the formula:

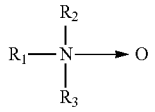

wherein $R_1$ is a $C_{12-18}$ alkyl and $R_2$ and $R_3$ are methyl or ethyl. The above ethylene oxide condensates, amides, and amine oxides are more fully described in U.S. Pat. No. 4,316,824. In another embodiment, the amine oxide is depicted by the formula:

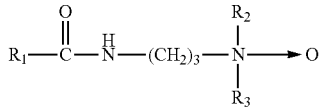

wherein $R_1$ is a saturated or unsaturated alkyl group having about 6 to about 24 carbon atoms, $R_2$ is a methyl group, and $R_3$ is a methyl or ethyl group. The preferred amine oxide is cocoamidopropyl-dimethylamine oxide.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a PLURAFAC™ surfactants (BASF) and condensates of ethylene oxide with sorbitan fatty acid esters such as the TWEEN™ surfactants (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 8 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

In one embodiment, the nonionic surfactants are the NEODOL™ ethoxylates (Shell Co.), which are higher aliphatic, primary alcohol containing about 9-15 carbon atoms, such as $C_9$-$C_{11}$ alkanol condensed with 2.5 to 10 moles of ethylene oxide (NEODOL™ 91-2.5 OR -5 OR -6 OR -8), $C_{12-13}$ alkanol condensed with 6.5 moles ethylene oxide (NEODOL™ 23-6.5), $C_{12-15}$ alkanol condensed with 7 moles ethylene oxide (NEODOL™ 25-7), $C_{12-15}$ alkanol condensed with 12 moles ethylene oxide (NEODOL™ 25-12), $C_{14-15}$ alkanol condensed with 13 moles ethylene oxide (NEODOL™ 45-13), and the like.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type arc $C_{11}$-$C_{15}$ secondary alkanol condensed with either 9 EO (TERGITOL™ 15-S-9) or 12 EO (TERGITOL™ 15-S-12) marketed by Dow Chemical.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include, but are not limited to, nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include IGEPAL™ CO-630 (nonyl phenol ethoxylate) marketed by GAF Corporation.

Also among the satisfactory nonionic surfactants are the water-soluble condensation products of a $C_8$-$C_{20}$ alkanol with a mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60-85%, preferably 70-80%, by weight. Such detergents are commercially available from BASF and a particularly preferred detergent is a $C_{10}$-$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$-$C_{20}$ alkanoic acid esters having a HLB of 8 to 15 also may be employed as the nonionic detergent ingredient in the described composition. These surfactants are well known and are available from Imperial Chemical Industries under the TWEEN™ trade name. Suitable surfactants include, but are not limited to, polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic surfactants are marketed under the trade name PLURONIC™. The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L 62 and L 64.

The alkyl polysaccharides surfactants, which can be used in the instant composition, have a hydrophobic group containing from about 8 to about 20 carbon atoms, preferably from about 10 to about 16 carbon atoms, or from about 12 to about 14 carbon atoms, and polysaccharide hydrophilic group containing from about 1.5 to about 10, or from about 1.5 to about 4, or from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In one embodiment, the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. In one embodiment, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides include, but are not limited to, decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

In one embodiment, the alkyl polysaccharides are alkyl polyglucosides having the formula $$R_2O(C_nH_{2n}O)_r(Z)_x$$

wherein Z is derived from glucose, R is a hydrophobic group selected from alkyl, alkylphenyl, hydroxyalkylphenyl, and mixtures thereof in which said alkyl groups contain from about 10 to about 18, preferably from about 12 to about 14 carbon atoms; n is 2 or 3, r is from 0 to 10; and x is from 1.5 to 8, or from 1.5 to 4, or from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is generally less than about 2%, or less than about 0.5% by weight of the total of the alkyl polysaccharide. For some uses it is desirable to have the alkyl monosaccharide content less than about 10%.

"Alkyl polysaccharide surfactant" is intended to represent both the glucose and galactose derived surfactants and the alkyl polysaccharide surfactants. Throughout this specification, "alkyl polyglucoside" is used to include alkyl polyglycosides because the stereochemistry of the saccharide moiety is changed during the preparation reaction.

In one embodiment, APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21-28%); n=16 (4-8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5-10 RPM of 3,000 to 7,000 cps.

The zwitterionic surfactant can be any zwitterionic surfactant. In one embodiment, the zwiderionic surfactant is a water soluble betaine having the general formula

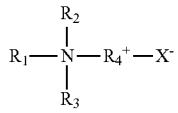

wherein $X^-$ is selected from $COO^-$ and $SO_3^-$ and $R_1$ is an alkyl group having 10 to about 20 carbon atoms, or 12 to 16 carbon atoms, or the amido radical:

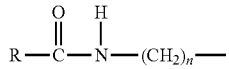

wherein R is an alkyl group having about 9 to 19 carbon atoms and n is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include, but are not limited to, decyl dimethyl betaine or 2-(N-decyl-N,N-dimethyl-ammonia)acetate, coco dimethyl betaine or 2-(N-coco N,N-dimethylammonia)acetate, myristyl dimethyl betaine, palmityl dimethyl betaine, lauryl dimethyl betaine, cetyl dimethyl betaine, stearyl dimethyl betaine, etc. The amidobetaines similarly include, but are not limited to, cocoamidoethylbetaine, cocoamidopropyl betaine and the like. The amidosulfobetaines include, but are not limited to, cocoamidoethylsulfobetaine, cocoamidopropyl sulfobetaine and the like. In one embodiment, the betaine is coco ($C_8$-$C_{18}$) amidopropyl dimethyl betaine. Three examples of betaine surfactants that can be used are EMPI- GEN™ BS/CA from Albright and Wilson, REWOTERIC™ AMB 13 and Goldschmidt Betaine L7.

The composition can contain a solvent. Examples of solvent include, but are not limited to, water, alcohol, glycol, polyol, ethanol, propylene glycol, polyethylene glycol, glycerin, and sorbitol. As the amount of solvent increases in the composition, the association between ion pairings in the liquid salt or choline salt is reduced. In certain embodiments, the amount of solvent is at least 1%, at least 5%, at least 10%, at least 15%, at least 20%, at least 25%, at least 30%, at least 35%, at least 40%, at least 50%, at least 55%, at least 60%, at least 65%, at least 70%, at least 75%, or at least 80%, or at least 85%, at least 90%, or at least 95% by weight.

The composition can have any desired pH. In some embodiments, the composition is acidic, pH is less than 6. In other embodiments, the composition is neutral, pH 6 to 8.

Additional optional ingredients may be included to provide added effect or to make the product more attractive. Such ingredients include, but are not limited to, perfumes, fragrances, abrasive agents, disinfectants, radical scavengers, bleaches, chelating agents, antibacterial agents/preservatives, optical brighteners, hydrotropes, or combinations thereof.

The compositions can be formulated into light duty liquid dish detergents, hard surface cleaners, spray cleaners, floor cleaners, bucket dilutable cleaners, microwave cleaners, stove top cleaners, or any type of home care cleaner. The compositions can be used by applying the composition to a surface or a wash bath, such as dishwashing. Once applied, the composition can soak on the surface or an article can soak in the wash to increase the cleaning time of the composition. Because of the increased cleaning efficiency of the composition, less water can be used, which results in increased sustainability. The composition can result in less scrubbing needed for cleaning or elimination of the need for scrubbing. The compositions can be used to remove baked on food from substrates.

Specific Embodiments of the Invention

The invention is further described in the following examples. The examples are merely illustrative and do not in any way limit the scope of the invention as described and claimed. When listed, Control Water refers to water that is made to have 150 ppm hardness of divalent ions to represent tap water.

Compositions are tested against common, difficult to clean, non-grease food soils. These food soils are starch and egg. Typically, for these difficult food soils, a common consumer practice is to presoak the food soil in water and dishwashing liquid before regular cleaning of dishes or on a surface, such as a stove top, before cleaning. Compositions are tested under presoak conditions.

The following procedure is used to make carbohydrate (potato starch) samples for testing. Potato starch (such as King Arthur potato flour) is mixed in a 1 to 4 volume ratio with water and mixed in a Braun multimixer with a puree attachment until smooth. Allow the mixture to gelatinize. A lab scale oven (such as convection or IR) is preheated to a temperature that correlates to a temperature of 176.7° C. (350° F.) to 204.4° C. (400° F.) of a standard home oven. 6.5 g of starch mixture are placed on a tarred stainless steel planchet and baked in the oven for 25 minutes.

The following procedure is used to make egg albumin samples for testing. Egg white powder (such as King Arthur egg white powder) is mixed in a 1 to 2 volume ratio with water. A lab scale oven (such as convection or IR) is preheated to a temperature that correlates to a temperature of 176.7° C. (350° F.) to 204.4° C. (400° F.) of a standard home oven. 4 g of the mixture are placed on a tarred stainless steel planchet and baked in the oven for 12 minutes.

The following procedure is used for soaking the planchets in test compositions to determine the amount of soil that is removed. Set a constant temperature bath with beaker holding rack to 22° C. (72° F.). Pour 100 ml of 46° C. (115° F.) test composition into a 150 ml beaker and place beaker in holding rack in water bath. Carefully slip test planchets in into beakers so they land soil side up lying flat on the bottom of the beaker. Allow soiled surface to soak undisturbed for determined time (15 or 30) minutes and then pull the planchets out and rinse briefly. Let the planchets dry overnight. Weigh the planchets to determine the percent by weight of the soil removed.

The following tests are used to determine the relationship of changing variables in formulas. The trends can be seen in the data presented. For the soaking tests, the starting temperature of the soaking composition is provided. The temperature is not maintained at the starting temperature as the composition is in a room at ambient temperature.

Impact of choline chloride:urea weight ratios on egg albumin removal after 30 minute soak at 46° C.

| % are by weight with the balance being water | % Removed |
|---|---|
| Control Water | 10 |
| 0.267% Dish liquid | 22 |
| 7.5% choline chloride | 13 |
| 15% choline chloride | 18 |
| 25% choline chloride | 32 |
| 50% chloine chloride | 62 |
| 7.5% choline chloride and 15% urea | 22 |
| 15% choline chloride and 7.5% urea | 19 |
| 15% choline chloride and 15% urea | 35 |
| 15% choline chloride and 30% urea | 50 |
| 15% choline chloride and 45% urea | 51 |

Impact of choline chloride with hydrogen bond donors on egg albumin removal after 30 minute soak at 46° C.

| % are by weight with the balance being water | % Removed |
|---|---|
| Control Water | 6 |
| 25% oxalic acid | 25 |
| 25% citric acid | 23 |
| 25% sodium citrate | 12 |
| 2.5% choline chloride | 27 |
| 25% choline dihydrogencitrate | 55 |
| 25% choline chloride and 25% oxalic acid | 52 |
| 25% choline chloride and 25% citric acid | 60 |
| 25% choline chloride and 25% sodium citrate | 50 |

Impact of surfactants on choline chloride on % added cleaning of the combination versus surfactant alone on egg albumin removal after 30 minute soak at 46° C. Choline chloride is 25 weight % and surfactant is 2 weight %. Composition is neutral pH. The numbers in parentheses show the actual % soil removed by the combination and the surfactant alone)

| Surfactant class | Surfactant | Choline Chloride |
|---|---|---|
| Nonionic | Pluronic F127 Ethylene Oxide/Propylene Oxide Block Copolymer | 137% (43%, 18%) |

-continued

| Surfactant class | Surfactant | Choline Chloride |
|---|---|---|
| | Neodol 25-7 alcohol ethoxylate surfactant | 80% (40%, 77%) |
| Amphoteric | Lauramidopropyldimethylamine oxide | 45% (33%, 23%) |
| | Cocamidopropyl betaine (30% active) | 44% (37%, 26%) |
| Anionic | Sodium linear alkyl benzene sulfonate | 5% (34%, 33%) |
| | Ammonium alkyl ether sulfate 1.2EO | 9% (33%, 31%) |
| Cationic | Cetrimonium bromide | 34% (29% 21%) |

Impact of choline chloride with different solvents on egg albumin removal after 30 minute soak at 46° C. PEG 600 is polyethylene glycol 600 molecular weight.

| % are by weight | % Removed |
|---|---|
| Control Water | 20 |
| 15% ethanol/85% water | 24 |
| 30% ethanol/70% water | 27 |
| 25% choline chloride/15% ethanol/60% water | 37 |
| 25% choline chloride/30% ethanol/45% water | 51 |
| 15% PEG600/85% water | 19 |
| 30% PEG600/70% water | 23 |

-continued

| % are by weight | % Removed |
|---|---|
| 25% choline chloride/15% PEG600/60% water | 38 |
| 25% choline chloride/30% PEG600/45% water | 42 |
| 15% glycerin/85% water | 23 |
| 30% glycerin/70% water | 32 |
| 25% choline chloride/15% glycerin/60% water | 44 |
| 25% choline chloride/30% glycerin/45% water | 48 |
| 15% propylene glycol/85% water | 36 |
| 30% propylene glycol/70% water | 39 |
| 25% choline chloride/15% propylene glycol/60% water | 46 |
| 25% choline chloride/30% propylene glycol/45% water | 47 |

The formulations below can be applied as low viscosity aerosol spray or pump spray products. Alternatively, they can be modified as needed with salts, surfactants, polymers or other thickening agents to produce moderately to highly viscous liquids, rinsing gels or gelled liquids that can be poured or wiped onto a soiled surface. The treatment can be used on baking dishes, conventional or microwave oven surfaces, cooking surfaces or other cooking device that has stuck on food residue. They are distinguished from the dish detergent formulations described below in that they contain no or low surfactant levels and thus are well suited for removing protein, carbohydrate and grease derived stains from other hard surfaces such as kitchen floors, bathroom tubs/shower stalls, sinks and toilet bowls. Consumers desire low foaming products which require minimal rinsing for these tasks. These formulas contain choline chloride and additionally contain a mixture of one or more co-solvents for enhanced performance. The solvent in these formulas is ethanol. Upon spraying on soiled surfaces, solvent portion of the formula rapidly evaporates>/=20° C. temperature, and the remaining, essentially non-volatile liquid salt becomes more concentrated for enhanced disruption of targeted soils. Formulation may additionally contain a mixture of one or more surfactants and other co-solvents (water, propylene glycol, etc.) for enhanced performance. Formulations show effective cleaning when applied liberally (equivalent weight to soil) in neat concentration to a soiled stainless steel substrate which is then gently rinsed (no physical agitation) with ambient temperature water after 15 minutes time to remove loose soil debris. Formulations with high alcohol content do not generally perform as well in removing carbohydrate soils as this type of soil needs sufficient hydration and swelling for easier removal. The high choline content and reduced alcohol formulas do provide this mechanism and are found to effectively clean both types of soil components.

| Material (wt %) | A | B | C | D | E | F | G | H | I | J | K | L |
|---|---|---|---|---|---|---|---|---|---|---|---|---|
| Choline chloride | 35 | | | | 50 | | | | 65 | | | |
| Choline salicylate | | 35 | | | | 50 | | | | 65 | | |
| Choline dihydrogencitrate | | | 35 | | | | 50 | | | | 65 | |
| Choline bicarbonate | | | | 35 | | | | 50 | | | | 65 |
| Propylene Glycol | 10 | 10 | 10 | 10 | 10 | 10 | 10 | 10 | 10 | 10 | 10 | 10 |
| Ethanol (SD3A) | 45 | 45 | 45 | 45 | 30 | 30 | 30 | 30 | 15 | 15 | 15 | 15 |
| Neodol 25-7 alcohol ethoxylate | 2 | 2 | 2 | 2 | 2 | 2 | 2 | 2 | 2 | 2 | 2 | 2 |
| Cocamidopropyl betaine (30% active) | 2 | 2 | 2 | 2 | 2 | 2 | 2 | 2 | 2 | 2 | 2 | 2 |
| Water | q.s. | q.s. | q.s. | q.s. | q.s. | q.s. | q.s. | q.s. | q.s. | q.s. | q.s. | q.s. |
| % Potato Soil Removed | 42 | 47 | 59 | 40 | 52 | 64 | 70 | 56 | 83 | 93 | 100 | 90 |
| % Egg Albumin Soil Removed | 69 | 79 | 68 | 75 | 79 | 86 | 77 | 85 | 80 | 100 | 94 | 100 |

The following formulas contain choline chloride and additionally contain solvents (water, propylene glycol, etc.) as well as one or more surfactants. Additionally, these formulas contain one or more hydrogen bond donors (such as urea or citric acid), which provide enhanced performance with reduced liquid salt concentrations. These formulations are targeted for pre-treatment of difficult to clean food soils from cooking items as well as general multipurpose cleaning tasks. They contain low levels of surfactant for formula stability and enhanced wetting of soils with low foaming profile. The approach has shown effectiveness m removing (potato and rice) carbohydrate and (egg) protein soils at room temperature. Example A in the table below is provided as a comparison of soil cleaning achieved by a 20% choline chloride formulation that does not contain a hydrogen bond donor such as urea. Also, it should be noted that acidic formulations such as formula D in the table below, which contain citric acid as the hydrogen bond donor and resulting formula pH between about 2.5 to 4.5, provide improved carbohydrate removal. All other formulas (letters A through C) in this example are approximately neutral pH.

| Material | A | B | C | D |
|---|---|---|---|---|
| Choline chloride | 20 | 20 | 40 | 30 |
| Urea | | 40 | 40 | |
| Citric acid | | | | 30 |
| Propylene glycol | 10 | 10 | 10 | 10 |
| Neodol 25-7 alcohol ethoxylate surfactant | 2 | 2 | 2 | 2 |
| Cocamidopropyl betaine (30% active) | 2 | 2 | 2 | 2 |
| Water | q.s. | q.s. | q.s. | q.s. |
| % Potato soil removed | 34 | 55 | 67 | 97 |
| % Egg albumin soil removed | 46 | 78 | 71 | 82 |

Acidic dish detergents were formulated that contain between 15-33% active surfactants and between 15-30% choline chloride. These acidic detergents of pH between 2.5 and 4.5 contain citric acid as a hydrogen bond donor. Citric acid functions in these formulas as both the acid buffer and H-bond donor. However, citric acid could be replaced by any of the hydrogen bond donors. Alternatively, sodium citrate or other H-bond donor could be utilized in combination with an acid source such as lactic acid, sulfuric acid, etc. provided that the selected H-bond donor is shelf stable in a finished acidic formulation. The table below describes both an acidic dish liquid base formula of high surfactant content (example A) and an acidic dish liquid base formula of proportionately reduced surfactant content (example B). Due to formulation constraints, the high surfactant formulation is limited to 15% wt. conc. of choline chloride and citric acid, respectively. Whereas, the reduced surfactant formulations are able to/be formulated with up to 30% wt. conc. of each material. Cleaning experiments were then conducted with either water (placebo) or choline chloride. Overall, the combination of higher choline chloride with reduced surfactant (base B formulas) provides improved cleaning compared to the reduced choline with high surfactant (base A) prototypes. Also, significantly better cleaning is observed with choline chloride formulations compared to the placebo in more concentrated 10% soak solution. Whereas, only directionally better cleaning is observed in most instances with choline chloride formulations compared to the placebo in 0.27% standard soak conditions. Also, it should be noted that carbohydrate removal is enhanced with acidic formulations, in general, compared to neutral or basic formulations shown below. The more concentrated prototype solutions provide greater buffering capacity and, in this case, provide and maintain a more acidic soak solution.

| | A<br>Wt. %<br>High Surfactant |
|---|---|
| Sodium alkyl ether sulfate 2EO | 14 |
| Sodium linear alkyl benzene sulfonate | 13 |
| Lauramdiopropyl betaine | 6 |
| Total surfactants | 33 |
| Other ingredients | |
| Choline Chloride or optional water | 15 |
| Citric acid | 15 |
| Ethanol (SD3A) | 4 |
| Sodium xylene sulfonate | 2.5 |
| Water | q.s. |
| Sulfuric acid/NaOH to target pH | q.s. |
| Rheology modifiers | q.s. |
| Fragrance and color and minors | q.s. |
| Target pH | 2.5-4.5 |

-continued

| Surfactants | B<br>Wt. %<br>Reduced Surfactant |
|---|---|
| Sodium alkyl ether sulfate 2EO | 6 |
| Sodium linear alkyl benzene sulfonate | 5 |
| Lauramdiopropyl betaine | 4 |
| Total surfactants | 15 |
| Other ingredients | |
| Choline Chloride or optional water | 30 |
| Citric acid | 30 |
| Ethanol (SD3A) | 2 |
| Sodium xylene sulfonate | 2.5 |
| Water | q.s. |
| Sulfuric acid/NaOH to target pH | q.s. |
| Rheology modifiers | q.s. |
| Fragrance and color and minors | q.s. |
| Target pH | 2.5-4.5 |

| Material wt. % | | A |
|---|---|---|
| Additional Water (no Choline chloride) | 15 | |
| Choline chloride | | 15 |
| % Potato soil removed after 15 minute soak | | |
| 0.27 weight % solution in water | 39 | 52 |
| 10 weight % solution in water | 51 | 67 |
| % Egg albumin soil removed after 30 min soak | | |
| 0.27 weight % solution in water | 23 | 24 |
| 10 weight % solution in water | 31 | 58 |

| Material wt. % | | B |
|---|---|---|
| Additional Water (no choline chloride) | 30 | |
| Choline chloride | | 30 |
| % Potato soil removed after 1.5 minute soak | | |
| 0.27 weight % solution in water | 42 | 59 |
| 10 weight % solution in water | 59 | 77 |
| % Egg albumin soil removed after 30 min soak | | |
| 0.27 weight % solution in water | 19 | 23 |
| 10 weight % solution in water | 33 | 59 |

Neutral dish detergents were formulated which contain between 11-27% active surfactants and between 15-30% choline chloride. These detergents of approximately pH 6-8 range contain urea as a hydrogen bond donor. Urea can alternatively be replaced by any of the hydrogen bond donors. Preferably this material would be of neutral pH or could be neutralized by a sufficient quantity of either acid or alkaline source to produce a storage stable finished formula of approximately neutral pH. The table below provides examples of both a neutral dish liquid base formula of high surfactant content (example C) and an neutral dish liquid base formula of reduced surfactant content (example D). The choline and urea were formulated at the highest concentrations possible in the respective surfactant bases and were formulated at a 1:1 weight ratio. However, it is possible to formulate up to a 4:1 weight ratio of urea:choline chloride to provide improved cleaning of food soils beyond formulations with each of these materials alone. Cleaning experiments were then conducted with either water (placebo) or choline chloride. Significantly better cleaning is observed with choline chloride formulations compared to the placebo in concentrated soak solutions and at least directionally better cleaning is observed compared to the placebo in the 0.27% standard soak conditions. While the acidic dish liquid formulas described above are particularly effective in removing carbohydrate-based soils, the neutral dish liquid formulas are particularly effective in removing protein-based soils. These cleaning benefits are more noticed with the higher choline chloride/reduced surfactant options (formulas B& D) which are the most preferred systems among the first generation prototypes.

| | C<br>Wt. %<br>High Surfactant |
|---|---|
| Sodium alkyl ether sulfate 2EO | 21 |
| Lauryl/Myristyl amine oxide | 6 |
| Total surfactants | 27 |
| Other ingredients | |
| Choline chloride or additional water | 15 |
| Urea | 15 |
| Ethanol (SD3A) | 4 |
| Sodium xylene sulfonate | 2.5 |
| Water | q.s. |
| Sulfuric acid/NaOH to target pH | q.s. |
| Rheology modifiers | q.s. |
| Fragrance and color and minors | q.s. |
| Target pH | 6-8 |

| | D<br>Wt. %<br>Reduced Surfactant |
|---|---|
| Sodium alkyl ether sulfate 2EO | 7 |
| Lauryl/Myristyl amine oxide | 4 |
| Total surfactants | 11 |
| Other ingredients | |
| Choline chloride or additional water | 30 |
| Urea | 30 |
| Ethanol (SD3A) | 2 |
| Sodium xylene sulfonate | 2.5 |
| Water | q.s. |
| Sulfuric acid/NaOH to target pH | q.s. |
| Rheology modifiers | q.s. |
| Fragrance and color and minors | q.s. |
| Target pH | 6-8 |

| | | C |
|---|---|---|
| Water (no liquid salt) | 15 | |
| Choline chloride | | 15 |
| % Potato soil removed after 15 minute soak | | |
| 0.27 weight % solution in water | 45 | 51 |
| 10 weight % solution in water | 52 | 69 |
| % Egg albumin soil removed after 30 min soak | | |
| 0.27 weight % solution in water | 22 | 23 |
| 10 weight % solution in water | 38 | 46 |

| Material wt. % | | D |
|---|---|---|
| Water (no liquid salt) | 30 | |
| Choline chloride | | 30 |
| % Potato soil removed after 15 minute soak | | |
| 0.27 weight % solution in water | 40 | 55 |
| 10 weight % solution in water | 48 | 67 |
| % Egg albumin soil removed after 30 min soak | | |
| 0.27 weight % solution in water | 27 | 35 |
| 10 weight % solution in water | 35 | 67 |

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

What is claimed is:

1. A cleaning composition comprising at least 15% by weight choline chloride and at least one of a surfactant and a solvent, wherein the surfactant is present and is at least one surfactant chosen from nonionic surfactants and amphoteric sufactants.

2. A cleaning composition comprising choline bicarbonate, surfactant, and solvent, wherein the amount of choline bicarbonate is at least 1% by weight, wherein at least one of a) the surfactant is at least one surfactant chosen from nonionic surfactants and amphoteric surfactants; and b) the composition further comprises a hydrogen bond donor.

3. A cleaning composition comprising at least 0.5% by weight of at least one choline salt chosen from choline salicylate and choline dihydrogencitrate, and at least one of a surfactant and a solvent, wherein at least one of a) the surfactant is present and is at least one surfactant chosen from nonionic surfactants and amphoteric surfactants; and b) the composition further comprises a hydrogen bond donor.

4. The cleaning composition of claim 1, wherein the amount of choline chloride is at least 20% by weight.

5. The cleaning composition of claim 2, wherein the amount of choline bicarbonate is at least 5% by weight.

6. The cleaning composition of claim 3, wherein the amount of choline salt is at least 1% by weight.

7. The cleaning composition of claim 1 further comprising a hydrogen bond donor.

8. The cleaning composition of claim 7, wherein the hydrogen bond donor is at least one material chosen from urea, aromatic carboxylic acids or their salts, salicylic acid, salicylate, benzoic acid, benzoate, dicarboxylic acids or their salts, oxalic acid, malonic acid, succinic acid, glutaric acid, adipic acid, tartaric acid, tricarboxylic acids or their salts, citric acid or its salts.

9. The cleaning composition of claim 7, wherein a weight ratio of hydrogen bond donor to choline salt is 1:1 to 4:1.

10. The cleaning composition of claim 1, wherein the surfactant is present in an amount of at least 0.1% by weight.

11. The cleaning composition of claim 1, wherein the surfactant is a nonionic surfactant.

12. The cleaning composition of claim 1, wherein the solvent is at least one solvent chosen from water, alcohol, glycol, polyol, ethanol, propylene glycol, polyethylene glycol, glycerin, and sorbitol.

13. The cleaning composition of claim 1, wherein the solvent comprises water and at least one additional solvent chosen from alcohol, glycol, polyol, ethanol, propylene glycol, polyethylene glycol, glycerin, and sorbitol.

14. The cleaning composition of claim 1, wherein the solvent is present at least 1% by weight.

15. The cleaning composition of claim 1, wherein the pH is less than 6.

16. The cleaning composition of claim 1, wherein the pH is 6 to 8.

17. A method of cleaning comprising applying the cleaning composition of claim 1 to a substrate, and optionally removing the cleaning composition.

18. The method of claim 17 further comprising leaving the composition on the substrate for a period of time and then removing the cleaning composition.

19. The method of claim 17, wherein the composition is added to a water bath before applying, and the substrate is immersed in the water bath.

20. A method of cleaning comprising applying a cleaning composition comprising at least 15% by weight choline chloride and at least one of a surfactant and a solvent to a substrate, and optionally removing the cleaning composition, wherein the method is dishwashing, oven cleaning, microwave oven cleaning, floor cleaning, bathroom tub cleaning, bathroom shower cleaning, sink cleaning, or toilet bowl cleaning.

21. A method of cleaning comprising applying a cleaning composition comprising at least 15% by weight choline chloride and at least one of a surfactant and a solvent to a substrate, and optionally removing the cleaning composition, wherein the substrate has baked on food.

22. The cleaning composition of claim 2, wherein the hydrogen bond donor is present and is at least one material chosen from urea, aromatic carboxylic acids or their salts, salicylic acid, salicylate, benzoic acid, benzoate, dicarboxylic acids or their salts, oxalic acid, malonic acid, succinic acid, glutaric acid, adipic acid, tartaric acid, tricarboxylic acids or their salts, citric acid or its salts.

23. The cleaning composition of claim 22, wherein a weight ratio of hydrogen bond donor to choline salt is 1:1 to 4:1.

24. The cleaning composition of claim 3, wherein the hydrogen bond donor is present and is at least one material chosen from urea, aromatic carboxylic acids or their salts, salicylic acid, salicylate, benzoic acid, benzoate, dicarboxylic acids or their salts, oxalic acid, malonic acid, succinic acid, glutaric acid, adipic acid, tartaric acid, tricarboxylic acids or their salts, citric acid or its salts.

25. The cleaning composition of claim 24, wherein a weight ratio of hydrogen bond donor to choline salt is 1:1 to 4:1.

* * * * *